US006899559B1

(12) United States Patent
Kao

(10) Patent No.: US 6,899,559 B1
(45) Date of Patent: May 31, 2005

(54) DIGITAL SIGNAL-INPUT/OUTPUT SOCKET STRUCTURE

(76) Inventor: Ta-San Kao, No. 2-1, Wen Hun Rd., Tung Hu Viilage, Ku Keng Hsiang, Yun Lin Hsien (TW)

( * ) Notice: Subject to any disclaimer, the term of this patent is extended or adjusted under 35 U.S.C. 154(b) by 0 days.

(21) Appl. No.: 10/778,134

(22) Filed: Feb. 17, 2004

(51) Int. Cl.[7] ..... H01R 11/00
(52) U.S. Cl. ..... 439/502
(58) Field of Search ..... 439/500–502, 439/457, 527, 559, 544

(56) References Cited

U.S. PATENT DOCUMENTS 2,655,638 A * 10/1953 Allen ..... 439/271
2,857,570 A * 10/1958 Simpson ..... 324/115
5,637,013 A * 6/1997 Weber ..... 439/502
6,056,591 A * 5/2000 Liao ..... 439/501
6,250,955 B1 * 6/2001 Archuleta ..... 439/502
6,709,284 B1 * 3/2004 Avlonitis ..... 439/457

* cited by examiner

*Primary Examiner*—J. F. Duverne
(74) *Attorney, Agent, or Firm*—Troxell Law Office, PLLC

(57) ABSTRACT

A digital signal-input/output socket structure comprises a guide post, a housing and two insulation sleeves. One end of the guide post connects a signal line, the other end allows insertion of a core post of an RCA plug of 75 Ω (ohm). A grounding piece is extended over the outer periphery the housing; the grounding piece is connected with the housing using a fixing nut. Two ends of the two coaxial insulation sleeves contacting with each other cooperatively form an annular groove; the guide post has peripherally thereof a protruding annular flange for engaging with and being positioned in the annular groove. The structure suits electric connection of digital and video signal lines etc. of an audio and video unit; it can make the characteristic impedances of the signal lines on the two ends of the socket and the plug match with each other after connecting of the socket with the plug, thereby signals can be accurately transmitted.

2 Claims, 6 Drawing Sheets

DIGITAL SIGNAL-INPUT/OUTPUT SOCKET STRUCTURE

BACKGROUND OF THE INVENTION

1. Field of the Invention

The present invention is related to a digital signal-input/output socket structure, and especially to a digital signal-input/output socket structure specific for plugging connection of a core post of an RCA plug with a characteristic impedance of 75 Ω suiting electric connection of digital and video signal lines etc. of an audio and video unit, it can make the characteristic impedances of the signal lines of the two ends of the socket structure and the RCA plug respectively match with each other after connecting of the socket structure with the plug, thereby signals can be accurately transmitted.

2. Description of the Prior Art

Generally, digital signal interfaces are divided into optical fibers and RCA coaxial digital lines; mostly a standard connector for coaxial digital lines is a normal BNC head with a characteristic impedance of 75 Ω (ohm), it is mated with a coaxial cable of 75 Ω to assure correct signal transmission without loss. However, coaxial lines sold in the markets presently all use RCA plugs, by the fact that initially RCA designs for transmitting audio signals, RCA plugs are less suitable to transmit digital signals by the reason that this may have a phenomenon of attenuation, the change in the characteristic impedance of them will have quite bad affection to digital signal transmitting.

Household machines normally use RCA plugs and sockets for coaxial inputting/outputting; as is shown in FIG. 5, an RCA plug "a" has its anode and cathode separated with an insulating separation layer "b" as a separating medium. A core post of the RCA plug "a" is made coarser in favor of insertion and extracting and being advantageous in not being subjected to bending and deforming, but this renders the characteristic impedance of the RCA plug "a" unable of reaching 75 Ω, and thereby the characteristic impedances of the two ends respectively of the RCA plug "a" and a digital signal-input/output socket "d" can not match with each other, this will make the output quality of digital signal transmitting be lowered and the requirement of acquiring its characteristics will be unable to meet.

In view of these, the inventor provides the present invention based on his professional experience of years and repeated experiments and tests in order that the characteristic impedances of the signal lines on the two ends can match with each other after connecting of the digital signal-input/output socket structure with the core post of the RCA plug with characteristic impedance of 75 Ω, thereby signals can be accurately transmitted.

SUMMARY OF THE INVENTION

The primary object of the present invention is to provide a digital signal-input/output socket structure, in which an insertion-connecting portion of a guide post has therein a bore coaxial with the guide post, the diameter of the bore can exactly afford insertion connecting of the core post of the RCA plug with characteristic impedance of 75 Ω; thereby the two ends can have identical characteristic impedances during signal transmitting after tight connecting of the digital signal-input/output socket with the RCA plug of 75 Ω, thereby signal distortion can be avoided.

To achieve the above stated object, the digital signal-input/output socket structure provided in the present invention is provided on both the inner and the outer side of the body of an audio and video unit for insertion connecting of an RCA plug of 75 Ω. The socket structure comprises an electric conductive housing having therein a guide post; the housing and the guide post of different polarities are separated by using two coaxial insulation sleeves. A welding portion on one end of the guide post is connected with a signal line in the audio and video unit, an insertion-connecting portion on the other end of the guide post can allow insertion of the RCA plug of 75 Ω to complete electric connection. A grounding piece is coaxially extended over the outer periphery the housing; the grounding piece is connected with the housing by means of a fixing nut. The present invention is characterized technically mainly in that: the insertion-connecting portion of the guide post has a bore coaxial with the guide post, the diameter of the bore can exactly afford insertion connecting of a core post of the RCA plug truly with characteristic impedance of 75 Ω; the housing has therein two coaxial insulation sleeves, two ends of the two coaxial insulation sleeves contacting with each other cooperatively form an annular groove, the guide post has peripherally thereof a protruding annular flange that can be engaged with and positioned in the annular groove.

The present invention will be apparent after reading the detailed description of the preferred embodiment thereof in reference to the accompanying drawings.

DETAILED DESCRIPTION OF THE PREFERRED EMBODIMENT

Figure 1:
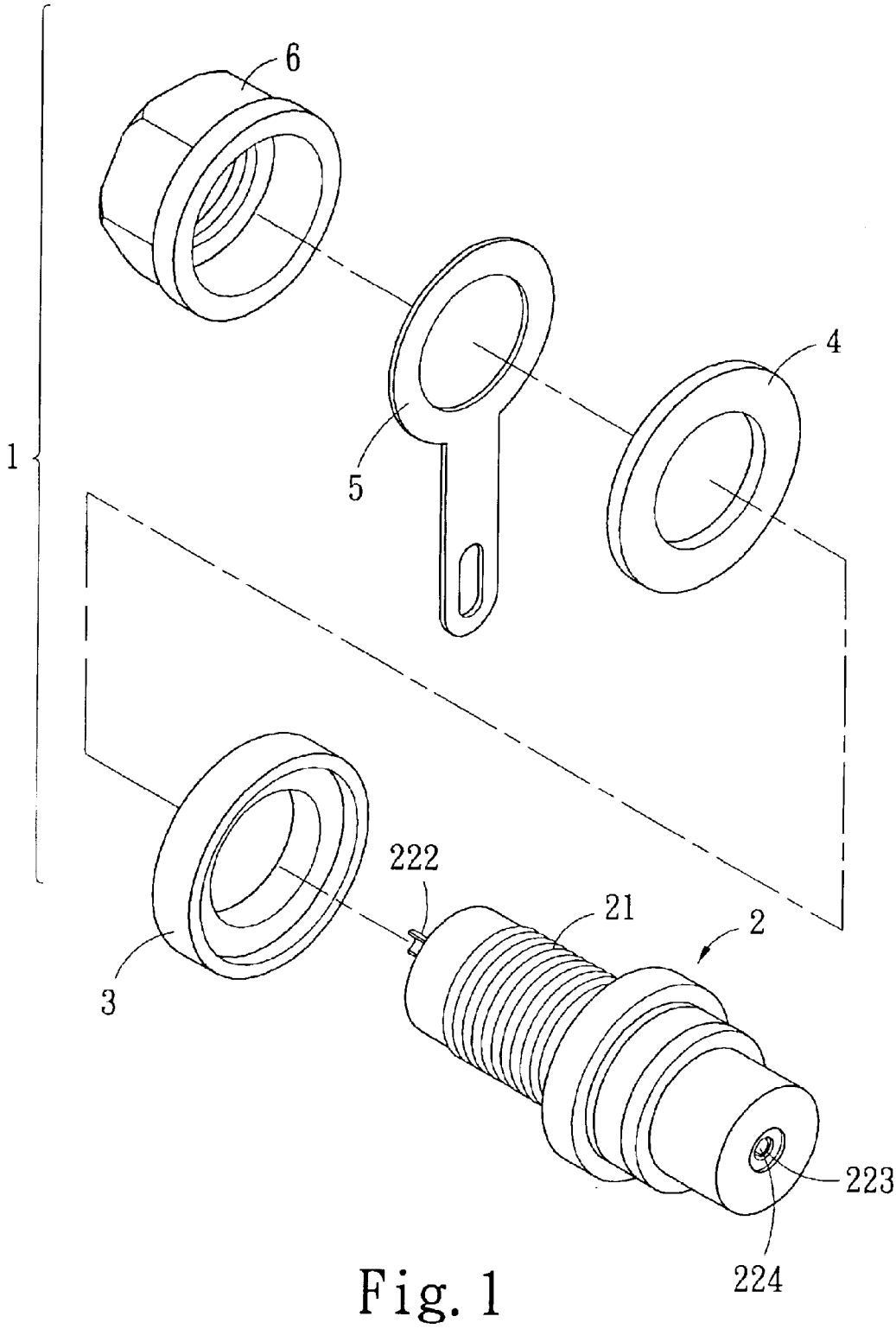
FIG. 1 is an analytical perspective view showing the elements of the digital signal-input/output socket structure of the present invention.
Figure 2:
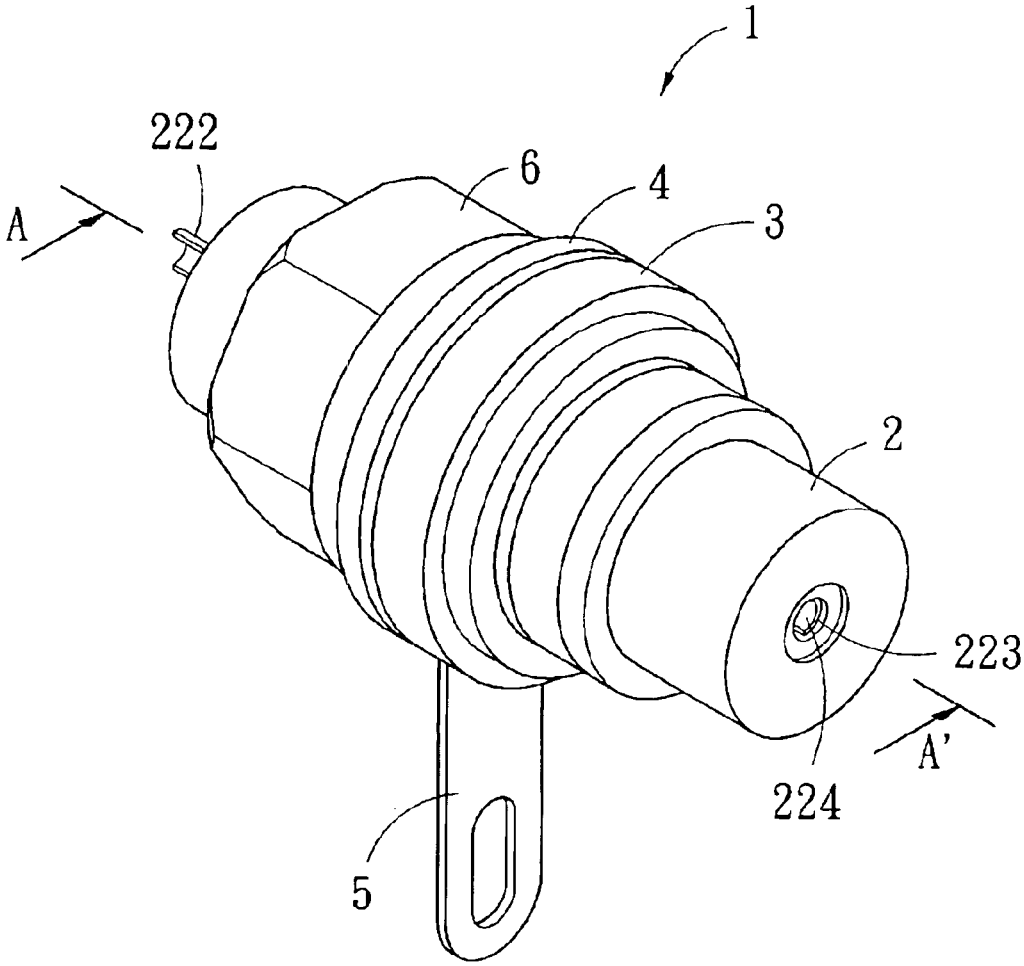
FIG. 2 is a perspective view showing the appearance of the digital signal-input/output socket structure of the present invention.
Figure 2A:
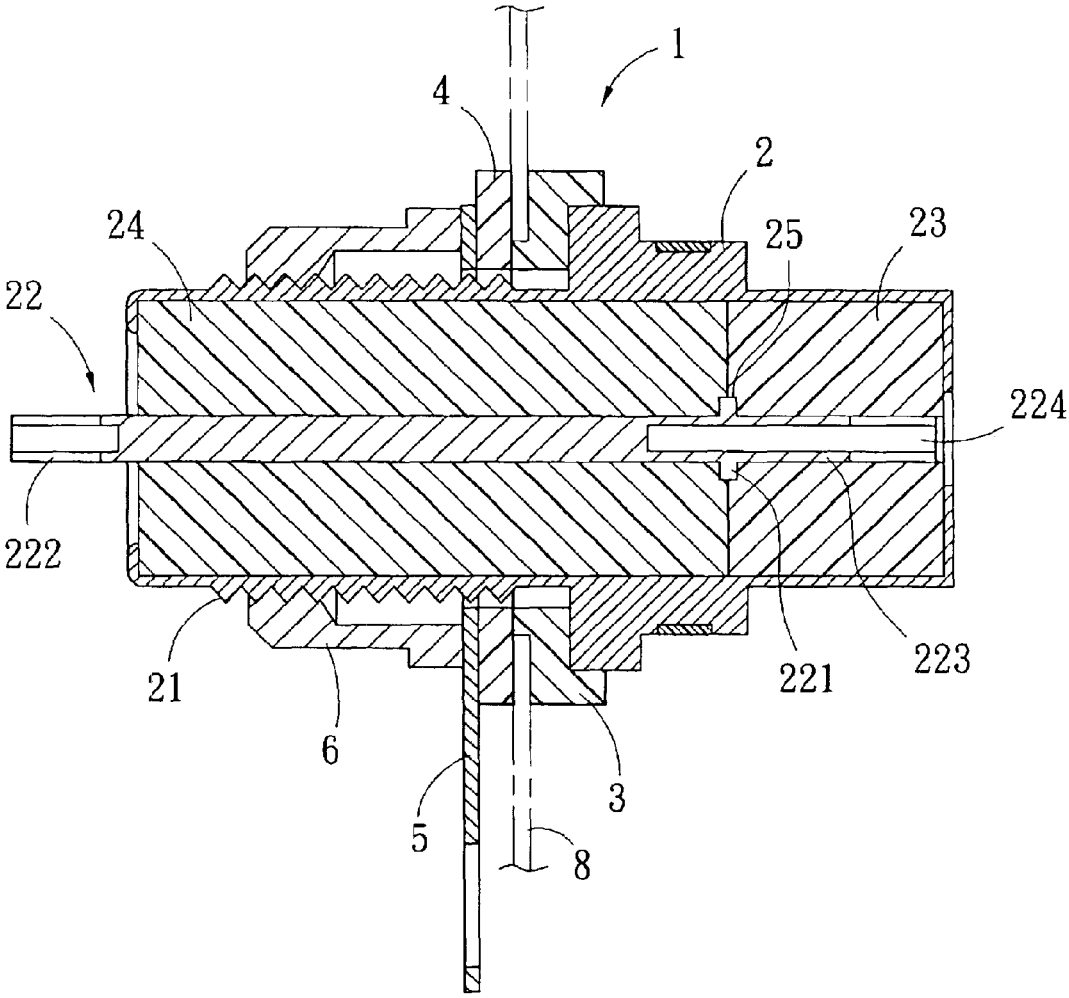
FIG. 2A is a sectional view taken from a sectional line A-A' in FIG. 2.

Referring to FIGS. 1–2A showing a preferred embodiment of the digital signal-input/output socket structure of the present invention, the digital signal-input/output socket structure 1 is provided on both the inner and the outer side of the body of an audio and video unit 8 (as shown in FIG. 2) for insertion connecting of the RCA plug 9. The socket structure 1 comprises the main elements of a housing 2, a front fixing insulation collar 3, a rear fixing insulation collar 4, a grounding piece 5 and a fixing nut 6.

The housing 2 is a cylinder having a stepped portion peripherally, it is made of electric conductive metal. The rear half portion of the housing 2 has an outer thread 21; the housing 2 further has therein a guide post 22. The housing 2 and the guide post 22 are separated by using two coaxial insulation sleeves 23, 24, thereby they are of different polarities. Two ends of the two coaxial insulation sleeves 23, 24 contacting with each other are recessed to cooperatively form an annular groove 25. When the two coaxial insulation sleeves 23, 24 and the guide post 22 are placed in the housing 2, the front half portion of the guide post 22 has peripherally thereof a protruding annular flange 221 that can be engaged with and positioned in the annular groove 25 of the two coaxial insulation sleeves 23, 24 to make positioning of the guide post 22. The two ends of the housing 2 are sealed internally, so that the two coaxial insulation sleeves 23, 24 and the guide post 22 are restrained from free moving. The guide post 22 has a welding portion 222 on one end thereof, the welding portion 222 is connected with a signal line (not shown) in the audio and video unit 8; the other end of the guide post 22 has an insertion-connecting portion 223 which has therein a bore 224 coaxial with the guide post 22.

The front fixing insulation collar 3 and the rear fixing insulation collar 4 are slipped over the periphery of the housing 2 to clamp and to be fixed on the body of the audio and video unit 8, so that the body of the unit 8 and the housing 2 are insulated from each other, and thereby the housing 2 is fixed. The grounding piece 5 is coaxially extended over the outer periphery of the housing 2, a fixing nut 6 is screw connected with the outer thread 21 on the rear half portion of the housing 2 to fix the grounding piece 5, and the grounding piece 5 forms with a circuit in the audio and video unit 8 a loop for grounding.

Figure 3:
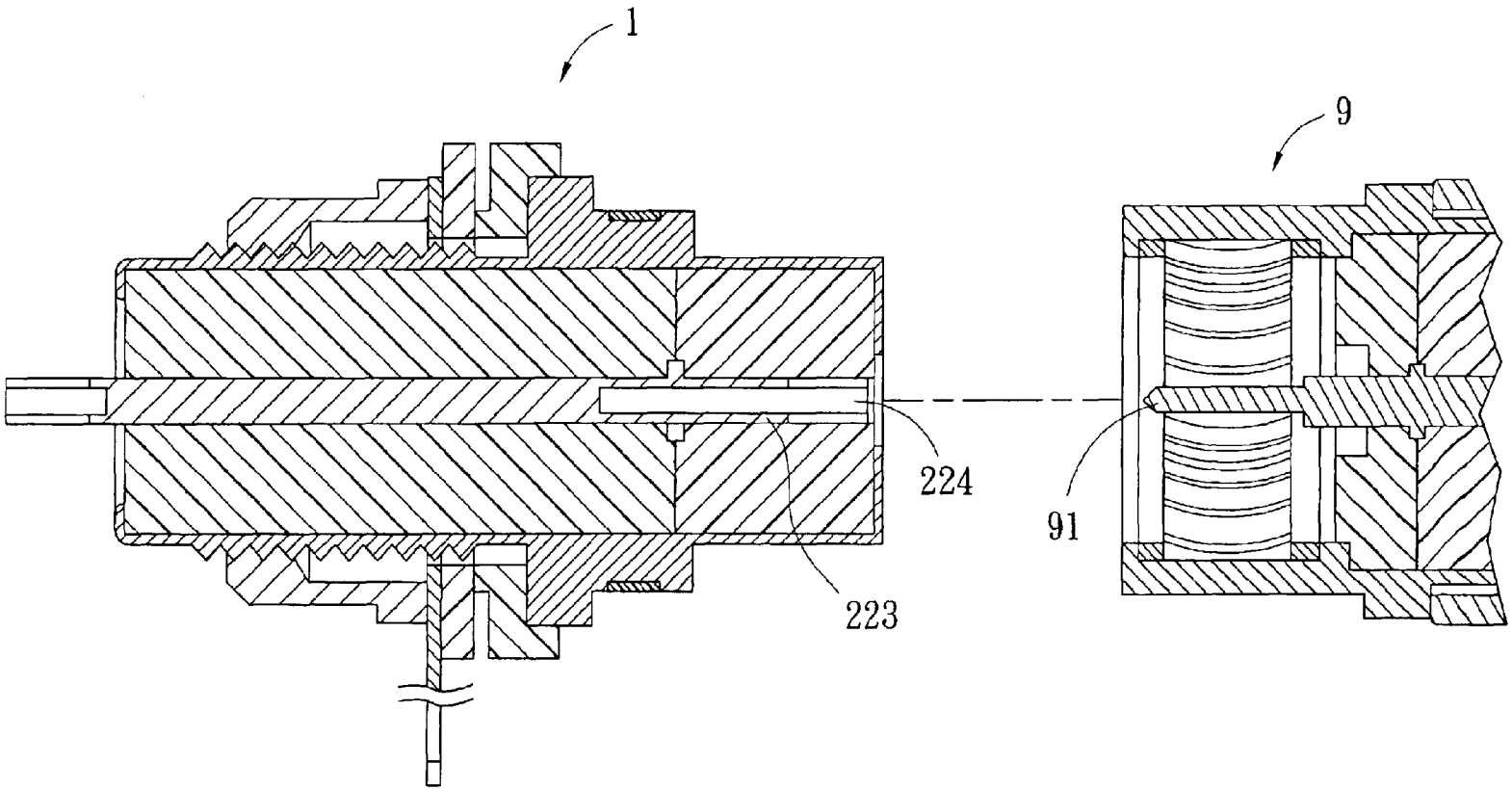
FIG. 3 is a schematic sectional view showing the state of use of the digital signal-input/output socket structure of the present invention in separation from an RCA plug.
Figure 4:
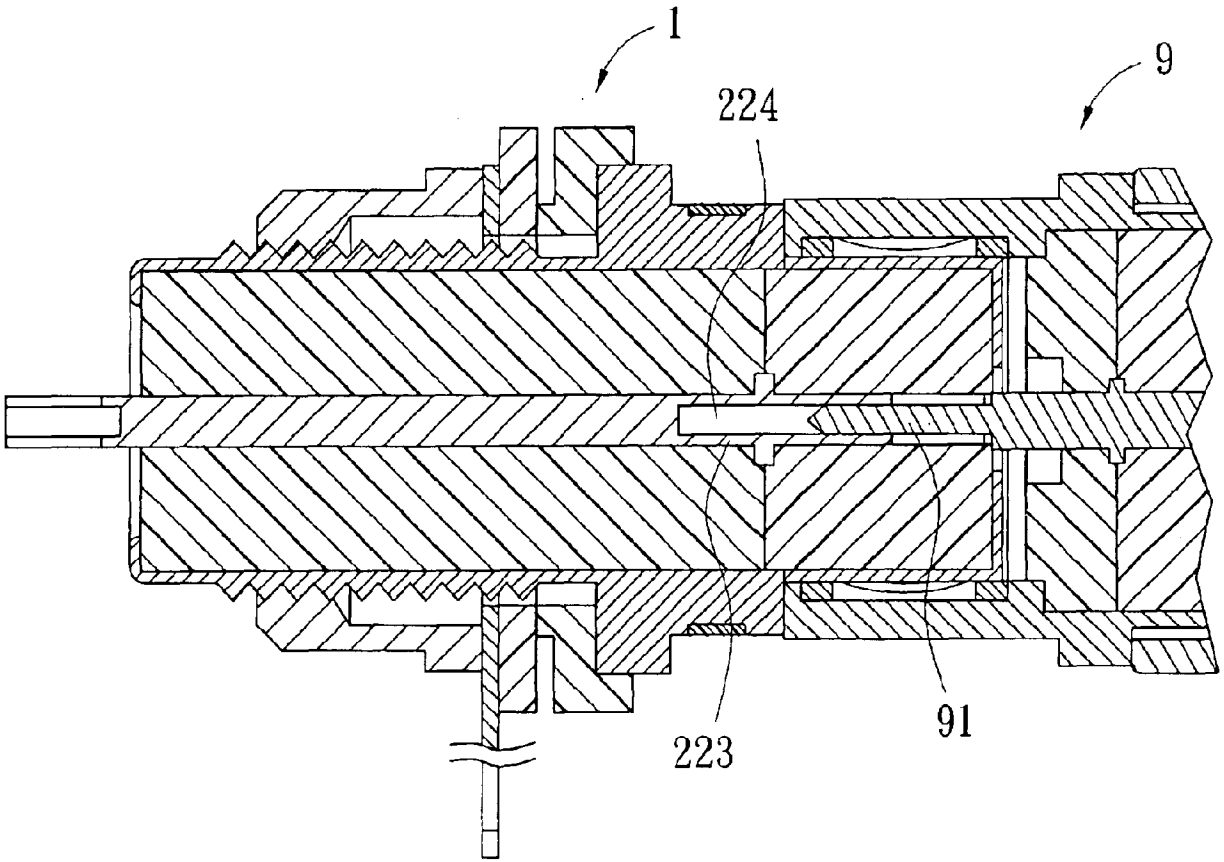
FIG. 4 is a schematic sectional view showing the state of use of the digital signal-input/output socket structure of the present invention in connecting with the RCA plug.
Figure 5:
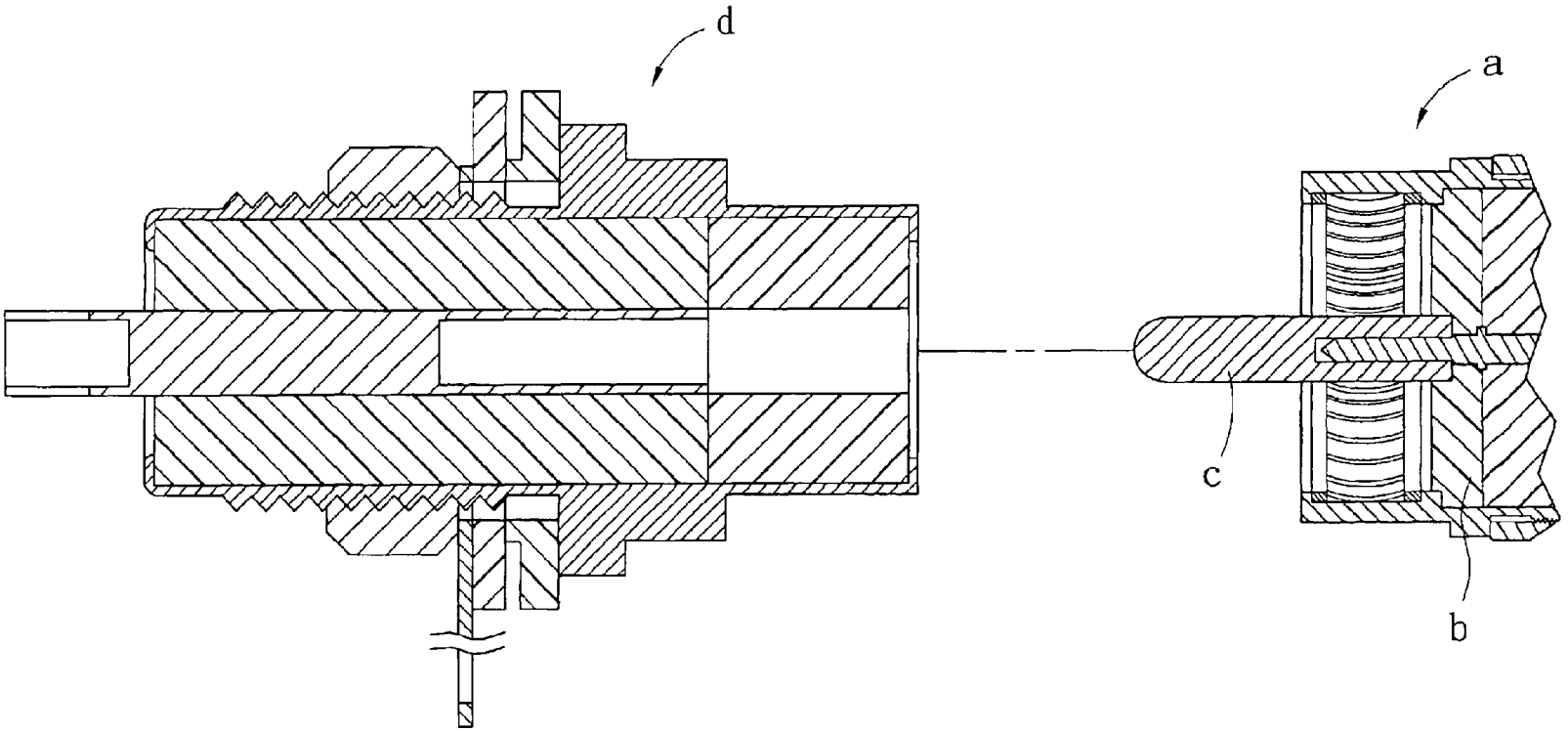
Fig. 5 (Prior Art)
FIG. 5 is a schematic sectional view showing the state of use of a conventional digital signal-input/output socket structure in separation from an RCA plug.

Referring to FIG. 3 showing the state of use of the present invention on an audio and video unit with high signal transmitting quality for insertion connecting of the RCA plug 9 truly with characteristic impedance of 75 Ω, wherein the rear end of a core post 91 of the RCA plug 9 is connected with a signal line having characteristic impedance of 75 Ω; the diameter of the core post 91 of the RCA plug 9 is small and is not further enlarged, the characteristic impedance of the signal line can be accurately converted by means of a formula to 75 Ω. When the core post 91 of the RCA plug 9 is insertion connected into the bore 224 of the insertion-connecting portion 223 of the digital signal-input/output socket structure 1 to form electric connection, the signal line on one end of the guide post 22 can too have characteristic impedance of 75 Ω (as shown in FIG. 4). Thereby, the signal lines of the two ends of the digital signal-input/output socket structure 1 and the RCA plug 9 can have identical characteristic impedances during signal transmitting, thereby signal distortion can be avoided.

Therefore, the present invention is advantageous in that: the insertion-connecting portion of the guide post has the bore coaxial with the guide post, the diameter of the bore can exactly afford insertion connecting of the core post of the RCA plug with characteristic impedance of 75 Ω; thereby the two ends of the digital signal-input/output socket and the RCA plug can have identical characteristic impedances during signal transmitting; for an audio and video unit of high quality, this can avoid signal distortion, and can meet the requirement of high signal transmitting quality.

In conclusion, according to the description disclosed above, the present invention surely can get the expected object thereof to provide a digital signal-input/output socket structure specific for plugging connection of a core post of an RCA plug with characteristic impedance of 75 Ω.

Having thus described the technical structure of my invention with the value of utility, therefore, what I claim as new and desire to be secured by Letters Patent of the United States are:

1. A digital signal-input/output socket structure, said structure is provided on both an inner and an outer side of a body of an audio and video unit for insertion connecting of an RCA plug, said socket structure comprises an electric conductive housing having therein a guide post; said housing and said guide post are of different polarities and are separated by using two coaxial insulation sleeves; a welding portion on one end of said guide post is connected with a signal line in said audio and video unit, an insertion-connecting portion on the other end of said guide post allows insertion of said RCA plug to complete electric connection; a grounding piece is coaxially extended over the outer periphery said housing; said grounding piece is connected with said housing by means of a fixing nut; said socket structure is characterized in that:

said insertion-connecting portion of said guide post has a bore coaxial with said guide post, the diameter of said bore exactly affords insertion connecting of a core post of said RCA plug with characteristic impedance of 75 Ω (ohm);

said housing has therein two coaxial insulation sleeves, two ends of said two coaxial insulation sleeves contacting with each other cooperatively form an annular groove, said guide post has peripherally thereof a protruding annular flange for engaging with and being positioned in said annular groove;

thereby two ends respectively of said socket structure and said RCA plug have identical characteristic impedances during signal transmitting, thereby signal distortion is avoided.

2. The digital signal-input/output socket structure as in claim 1, wherein said socket structure further comprises a front fixing insulation collar and a rear fixing insulation collar to clamp and to be fixed on said body of said audio and video unit.

* * * * *